US006367148B1

(12) United States Patent
Caveney et al.

(10) Patent No.: US 6,367,148 B1
(45) **Date of Patent: *Apr. 9, 2002**

(54) TERMINAL APPLICATOR MOVEMENT CONTROL MECHANISM

(75) Inventors: Jack E. Caveney, Hinsdale; John J. Bulanda, New Lenox, both of IL (US)

(73) Assignee: Panduit Corp., Tinley Park, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/881,975

(22) Filed: Jun. 25, 1997

(51) Int. Cl.[7] ..... H01R 43/04

(52) U.S. Cl. ..... 29/753; 29/33 M; 29/748; 29/751; 29/755; 29/861; 29/863; 72/409.06; 72/409.14; 72/413; 72/712

(58) Field of Search ..... 29/33 M, 751, 29/753, 755, 861, 863, 748; 72/409.06, 409.14, 413, 712

(56) References Cited

U.S. PATENT DOCUMENTS

| | | | | |
|---|---|---|---|---|
| 2,765,468 A | | 10/1956 | Cootes et al. | |
| 3,062,390 A | | 11/1962 | Schwalm et al. | |
| 3,186,076 A | | 6/1965 | Cobaugh | |
| 3,263,316 A | | 8/1966 | Schrader | |
| 3,386,153 A | | 6/1968 | Lau et al. | |
| 3,416,213 A | | 12/1968 | Cootes | |
| 3,481,018 A | | 12/1969 | Van De Kerkhof | |
| 3,541,654 A | | 11/1970 | Hills | |
| 3,745,807 A | | 7/1973 | Vogel et al. | |
| 4,025,999 A | | 5/1977 | Wolyn et al. | |
| 4,031,613 A | | 6/1977 | Brown et al. | |
| 4,040,180 A | | 8/1977 | Brown | |
| 4,114,253 A | | 9/1978 | Loomis et al. | |
| 4,178,675 A | | 12/1979 | Phillips | |
| 4,718,160 A | | 1/1988 | Bulanda et al. | |
| 4,979,291 A | | 12/1990 | Phillips et al. | |
| 5,131,124 A | | 7/1992 | Skotek | |
| 5,440,799 A | * | 8/1995 | Marshall et al. | 29/753 X |
| 5,481,796 A | | 1/1996 | Quinn | |
| 5,799,391 A | * | 9/1998 | Tillotson | 29/753 |

FOREIGN PATENT DOCUMENTS

| | | | | |
|---|---|---|---|---|
| JP | 63-298987 | * | 12/1963 | 29/748 |

* cited by examiner

*Primary Examiner*—Lee Young
*Assistant Examiner*—Rick Kiltae Chang
(74) *Attorney, Agent, or Firm*—Robert A. McCann

(57) ABSTRACT

A terminal applicator comprising a terminal advancing mechanism which includes a mechanism for reciprocally advancing and retracting a feed finger which resiliently biases a terminal strip from a first position to a second advanced position in alignment with a crimp die, and a device for controlling reciprocal movement of the advancing mechanism by interacting with the feed finger, whereby feed and retract limits are defined.

12 Claims, 12 Drawing Sheets

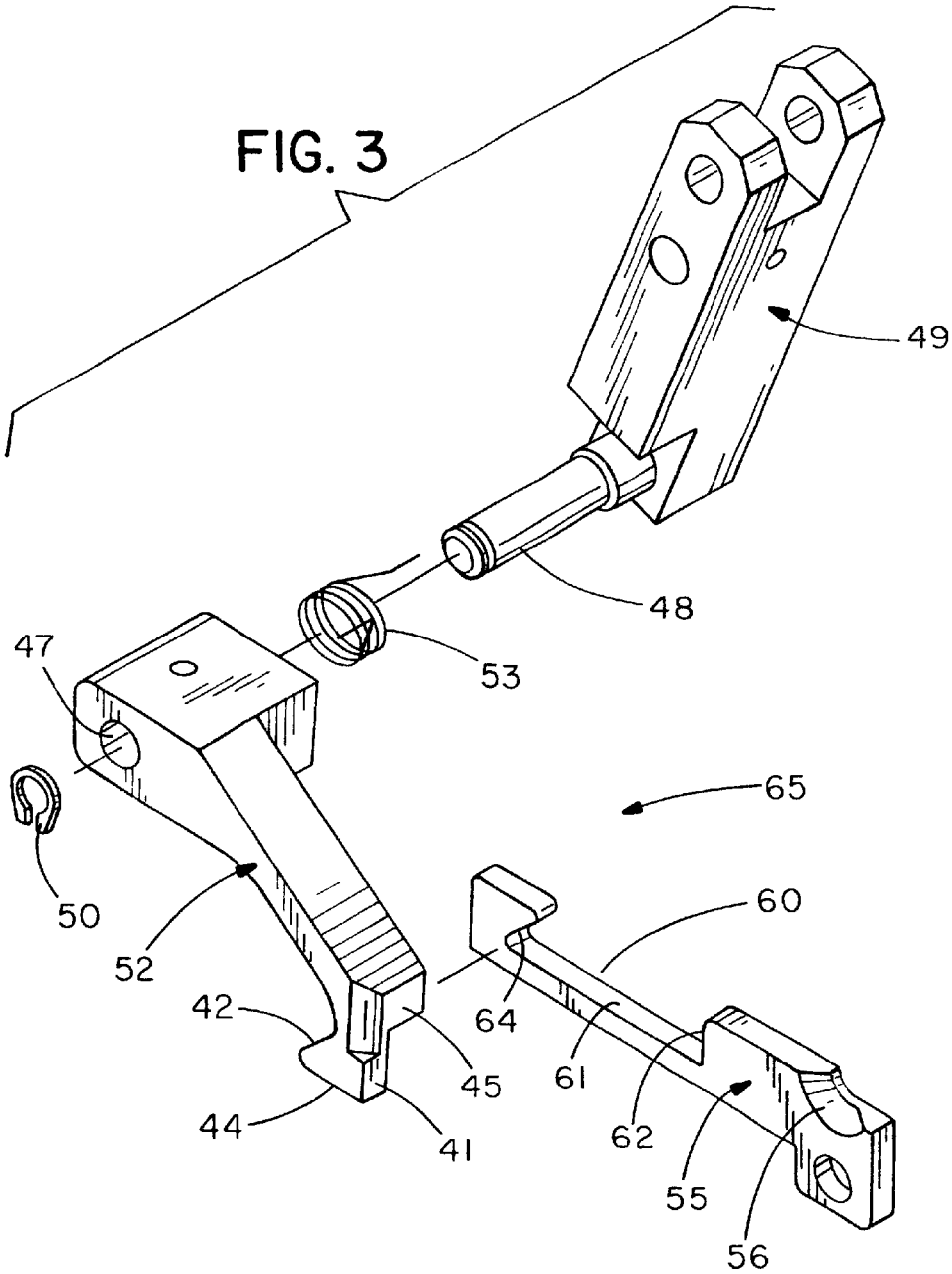
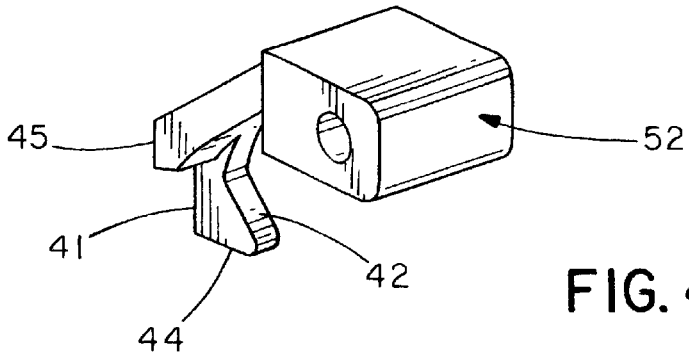
FIG. 4

TERMINAL APPLICATOR MOVEMENT CONTROL MECHANISM

TECHNICAL FIELD

The present invention relates generally to terminal applicators which automatically crimp successive terminals or connectors to wires, where the terminals or connectors are provided in strip form, and more specifically to an applicator which has a specially adapted, interchangeable movement control device which may incorporate the proper feed stroke limit, retract stroke limit or crimp die which corresponds to the progression and style of terminal or connector being applied.

BACKGROUND OF THE INVENTION

Crimping machines have been found to be very useful for the purpose of effectively crimping insulated and uninsulated metal terminals or connectors onto a stripped, insulated wire lead. A conventional crimping machine comprises a press and a terminal applicator. The applicator is, in effect, a miniature press which has a press frame and a reciprocable ram in the frame which is coupled to the ram of the press. Furthermore, an applicator also has a crimping zone, an area in which the crimping tooling is mounted, and a self-contained feeding mechanism for feeding terminals or connectors, in strip form, into the crimping zone.

The terminal feeding mechanism usually associated with such a crimping machine successively advances the terminals or connectors, in strip form, into the crimp dies. Commonly, this mechanism may be activated in many different ways, the usual methods include a camming surface built into the applicator ram, an air cylinder activated by switches contacting upper die set, or applicator ram surfaces, or an electronically operated air cylinder. Each of these terminal feeding common mechanism activation methods usually motivates some form of linkage connected to a feed finger. Basically, the terminal feeding mechanism reciprocates the feed finger to place a next terminal or connector in the crimp zone.

The advent and increasing use of continuously molded insulative terminal strip technology has increased the structural variety of terminal strips available for high speed and high volume terminating applications, and the need for an applicator which can be adapted to apply a wide variety of continuously molded insulative terminal strips having a variety of pitches, diameters, strip widths and shapes.

Continuously molded insulative strips are formed by molding a strip of spaced plastic terminal insulating housings transversely positioned along the length of the strip with adjacent barrels being interconnected by plastic ribbon portions molded therebetween. Metal terminal or connector elements are then inserted within the insulative housings to complete the continuously molded terminal strip portions. Typically, the insulating housings are formed with a plastic barrel portion for insulating the crimp-barrel portion of the terminal, a plastic funnel portion for directing a wire into the metal barrel portion and, if desired, a terminal portion to insulate the metal terminal blade; the metal terminal blade being formed in a number of sizes and shapes, for example, locking fork terminals, female disconnects, right angle female disconnects, and male disconnects.

Uninsulated terminals, such as disconnect terminals, ring terminals, fork terminals, pin terminals, etc., are commonly known as chain terminals, which are currently available and widely used for many applications. These terminals are also provided in strip form, but are sometimes oriented differently than the insulated terminals. In those instances, the uninsulated terminals are joined in a head-to-toe fashion rather than the side-to-side arrangement of other insulated and uninsulated terminals. As a consequence, the crimping machine for head-to-toe chain terminals is slightly different. Most notably, the applicator and its corresponding upper and lower die sets are arranged such that the chain terminals are advanced along the longitudinal axis of the die sets, thus approaching from behind the die sets rather than approaching laterally. Otherwise, the function and operation of the applicator is virtually identical.

Conventional crimping machines, such as U.S. Pat. No. 4,718,160 to Bulanda et al., and U.S. Pat. No. 2,765,468 to Cootes et al., permit adjustment of the feed stroke, retract stroke and crimp dies for a variety of different types and progressions of terminals or connectors. These adjustments, however, are usually made independently of each other for each different type and progression of terminal or connector. Thus, machine down time and change over speed are increased while operator efficiency is decreased. Separate controls for each adjustment also requires more trial runs after change over to achieve proper advance, retract, crimp pocket dimension, and consequently there is an increase in wasted product.

Therefore, a simple, inexpensive, quickly changed, and precisely accurate feed finger progression control mechanism is desired and improvement in the art of terminal applicator design is needed.

SUMMARY OF THE INVENTION

It is therefore an object of the present invention to provide an improved terminal strip applicator.

It is another object of the present invention to provide one, single part change which eliminates many independent adjustments.

It is another further object of the present invention to reduce machine down time and change over speed while increasing operator efficiency.

It is another still further object of the present invention to eliminate unnecessary adjustments which result in increased trial runs and wasted product.

It is another still further object of the present invention to provide a movement control device which may incorporate a feed stop limit, a retract stop limit, or the correct crimp die.

It is another still further object of the present invention to provide a movement control device which is interchangeably mounted to a terminal applicator.

It is another still further object of the present invention to provide a movement control device which interacts with the distal end of the feed finger to limit the feed and retract movements.

It is another still further object of the present invention to provide a retract stop limit with a reversely curved wall which engages a correspondingly shaped feed finger.

In general, an applicator embodying the present invention includes a terminal advancing mechanism which has a device for reciprocally advancing and retracting a feed finger which resiliently biases a terminal strip from a first position to a second advanced position in alignment with a crimp die, and a device for controlling reciprocal movement of the advancing mechanism by interacting with the feed finger, whereby advance and retract limits are defined.

BRIEF DESCRIPTION OF THE DRAWINGS

FIG. 3. is an exploded perspective drawing of the feed finger and movement control device of the applicator of FIG. 1.

FIG. 4 is a rear perspective view of the feed finger of the applicator of FIG. 1.

DESCRIPTION OF THE PREFERRED EMBODIMENT

Figure 1:
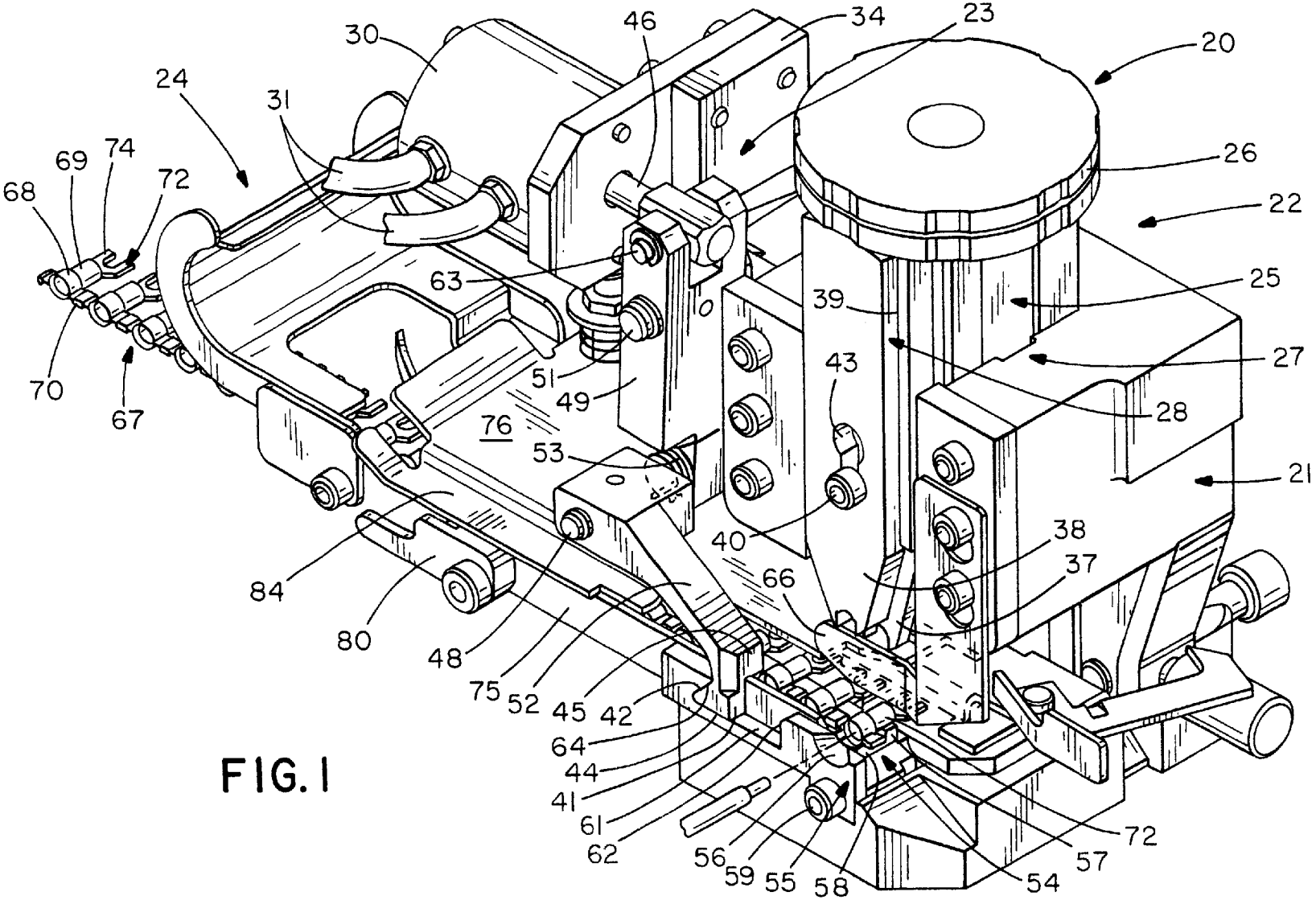
FIG. 1 is a perspective drawing of an applicator embodying the concept of the present invention.
Figure 12:
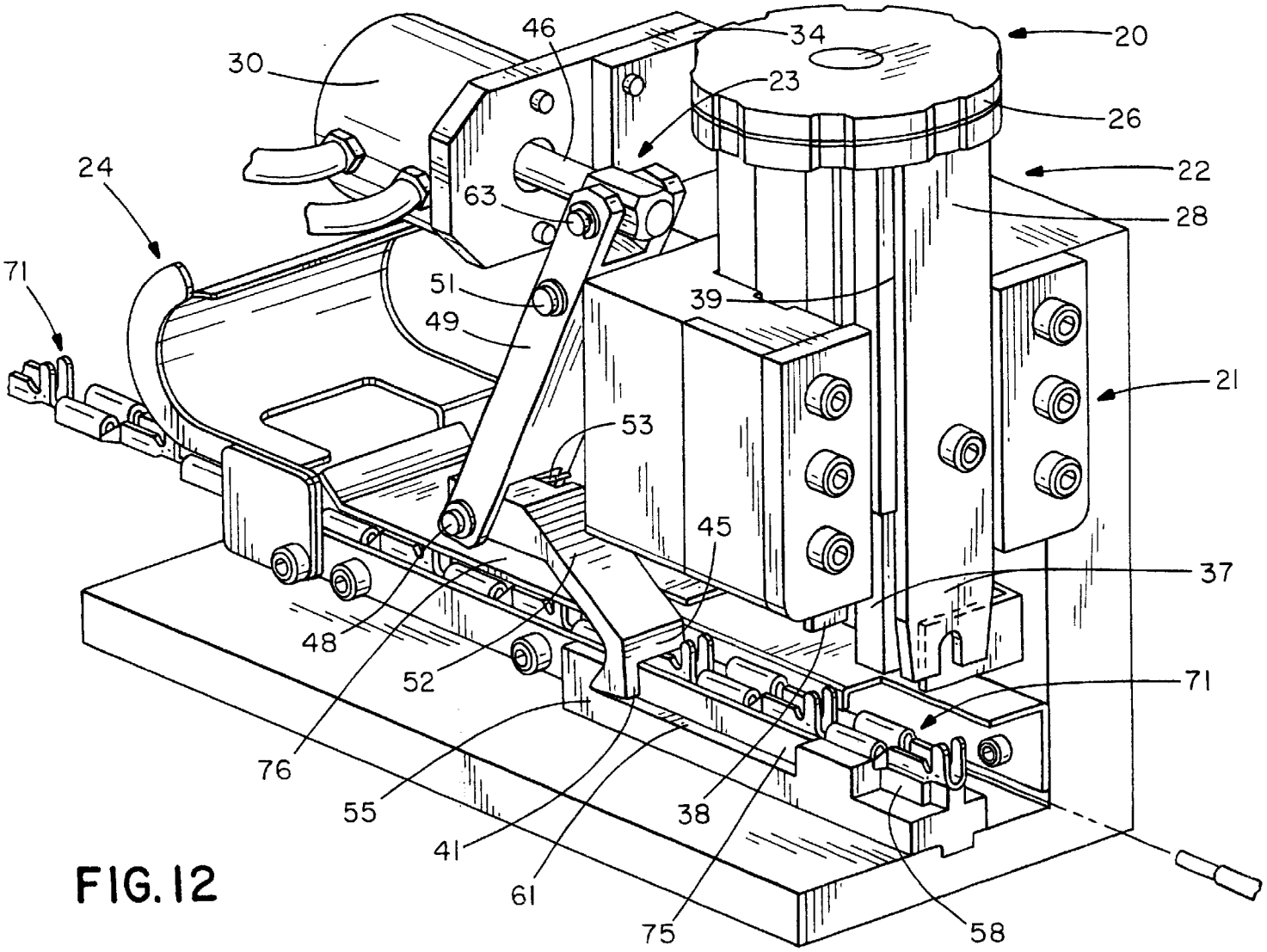
FIG. 12 is a front perspective view of an applicator embodying the concept of the present invention used with uninsulated chain terminals.

An applicator embodying the concept of the present invention is designated generally by a numeral 20 in the accompanying drawings. Different types of terminal applicators, as seen in FIGS. 1 and 12, each embody the concept of the present invention. Each applicator is comprised of the same parts only the arrangement differs, therefore part identification numbers are the same for each applicator.

Applicator 20 includes a machine body 21, ram assembly 22, terminal feed mechanism 23 and track assembly 24. Applicator 20 is designed as an interchangeable unit that can be mounted in a press having means to engage and reciprocate ram assembly 22.

Figure 2:
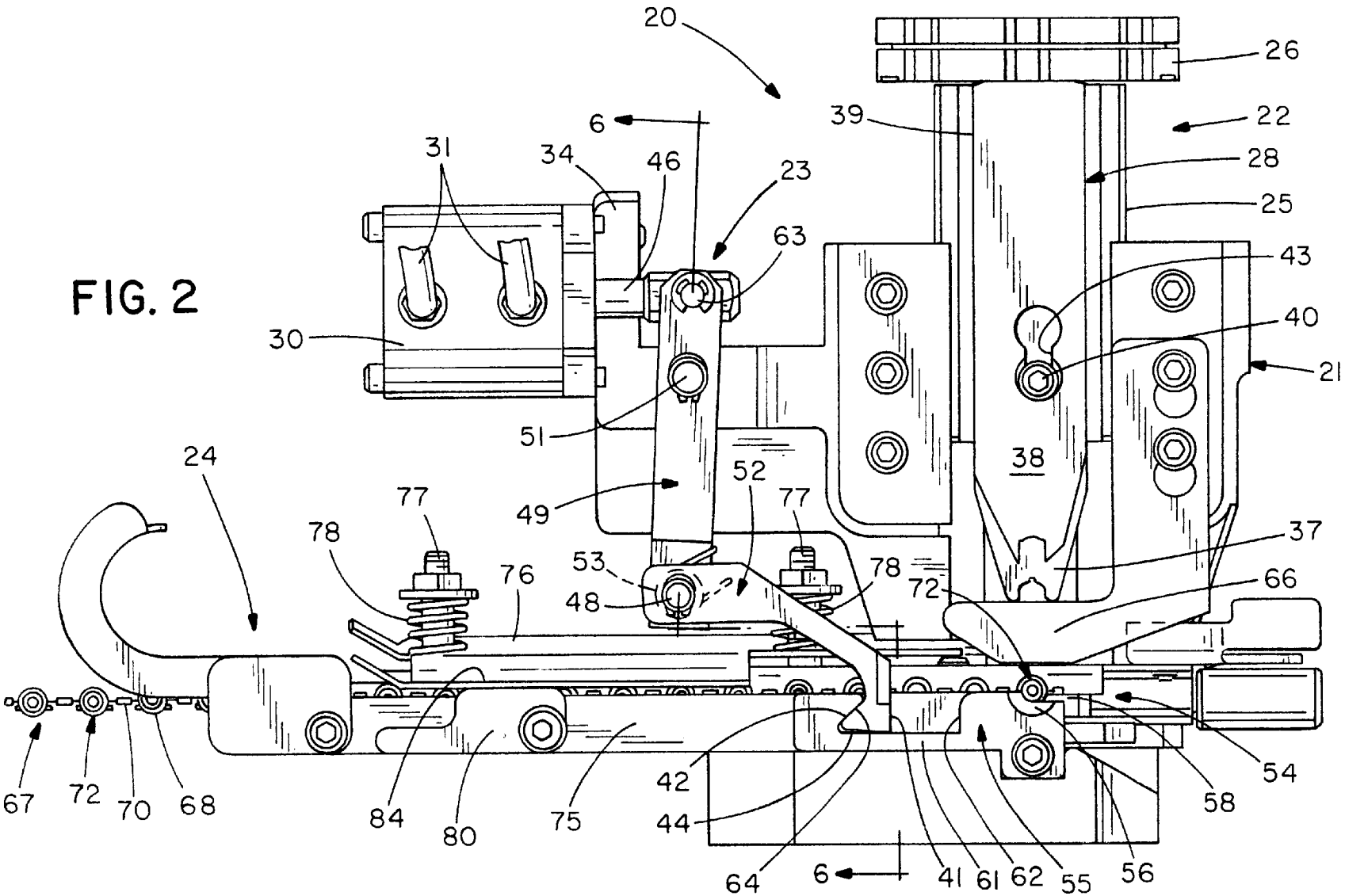
FIG. 2. is a front view of the applicator of FIG. 1, showing the feed finger fully retracted.

Ram assembly 22 is mounted for reciprocal action within a track in machine body 21. As best seen in FIGS. 1 and 2, ram assembly 22 preferably includes a ram body 25, die adjustment dials 26, internal die biasing mechanism (not shown) and an upper interchangeable die set 28.

Figure 7:
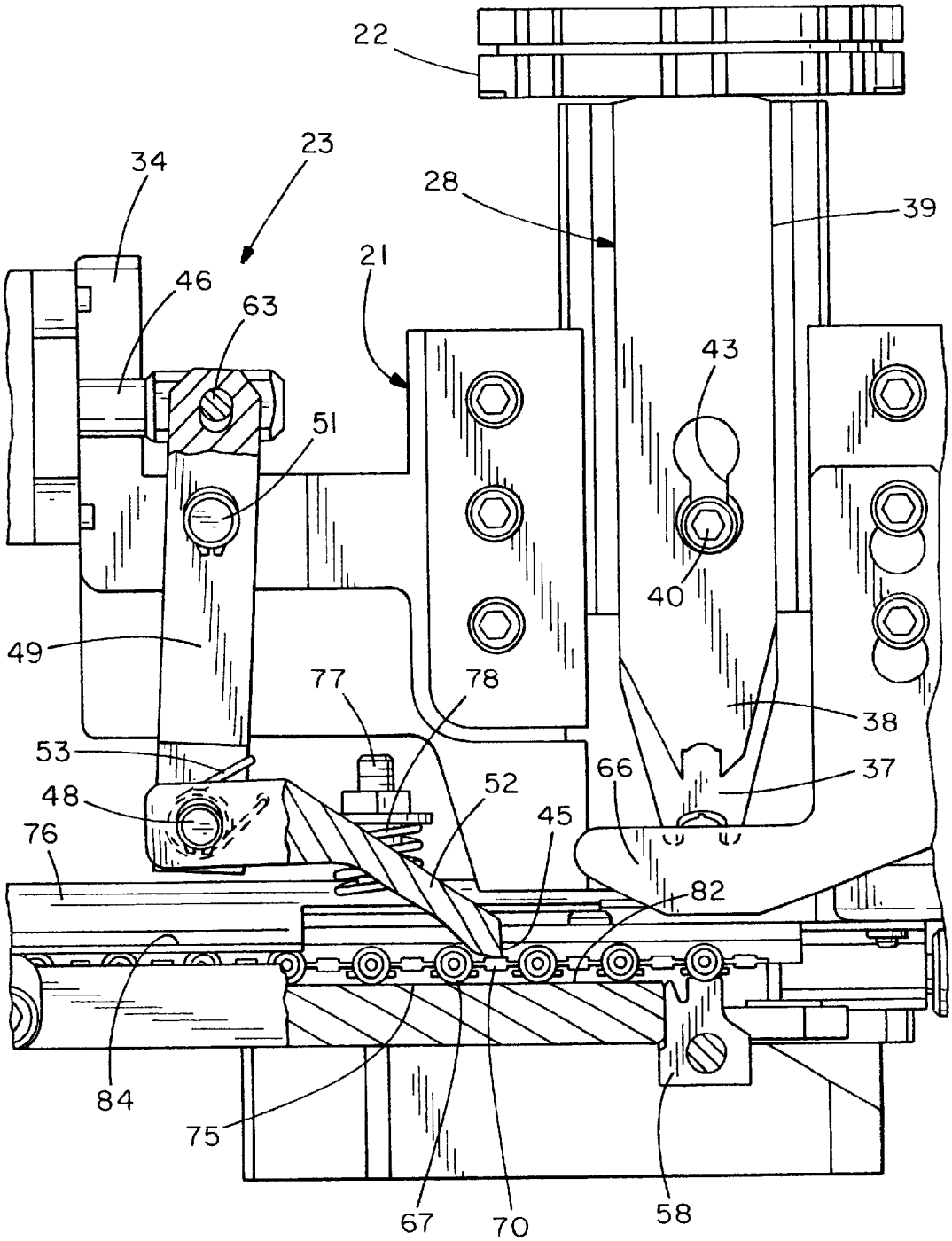
FIG. 7 is a partial front view of the applicator of FIG. 1, showing portions of the feed finger, track and movement control device/lower crimp die broken away.

The upper interchangeable die set 28 includes a terminal crimp die 37 and a severance die 38. As best seen in FIGS. 2 and 7, die set 28 is mounted within a die track 39 by a bolt 40 that is received in a threaded bore. A key hole slot 43 in the severance die 38 accepts mounting bolt 40 and allows the removal of die set 28 by merely loosening bolt 40. Die adjustment dials 26 may be rotated to set the height of the upper die set 28, so as to generate the optimum crimp. Different severance and crimp dies are used for different sizes and types of terminals or connectors and therefore interchangeability is essential to efficient machine operation.

Figure 5:
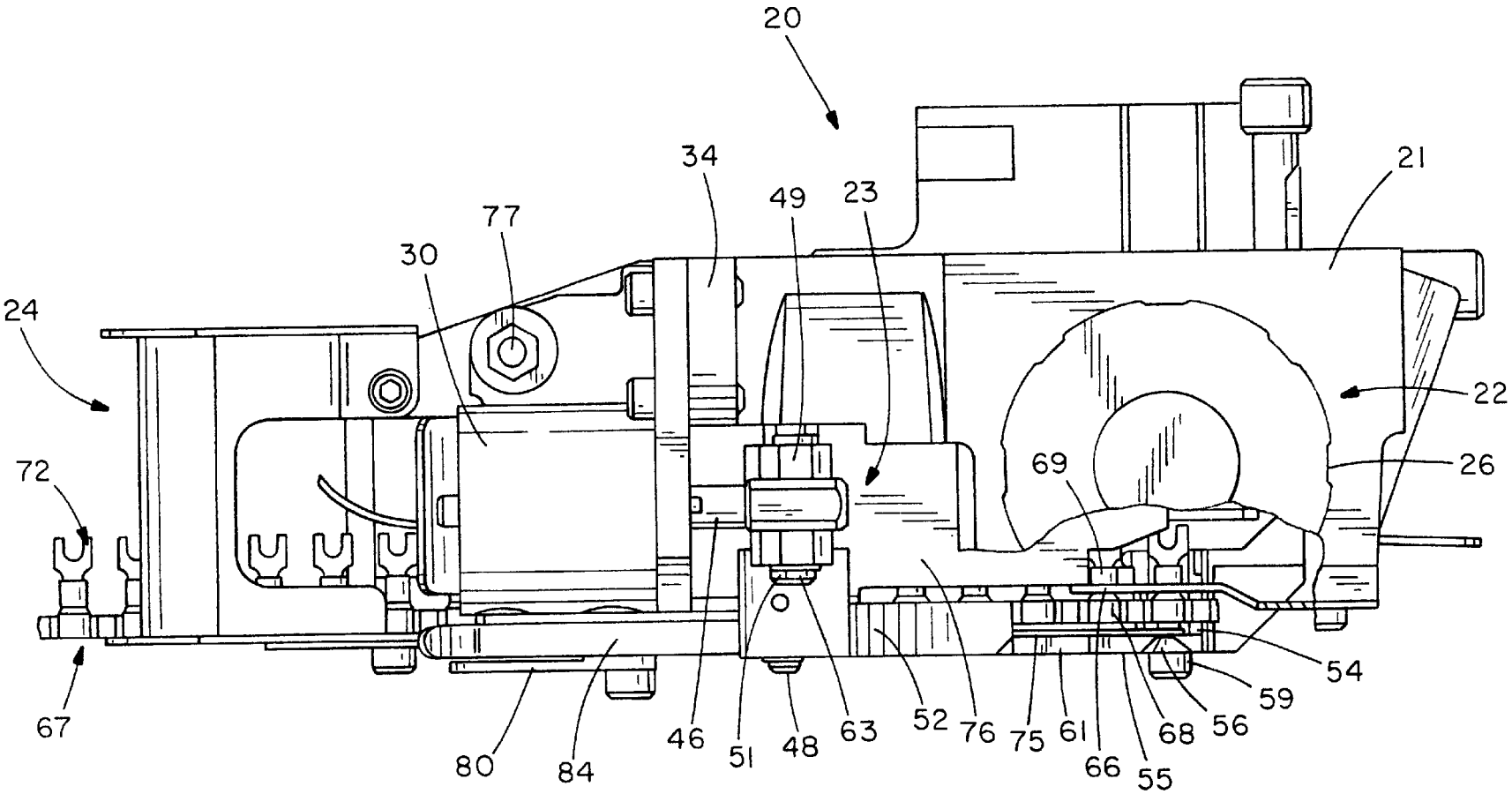
FIG. 5 is a top view of the applicator of FIG. 1, showing the ram assembly broken away to reveal the feed finger fully retracted.
Figure 9:
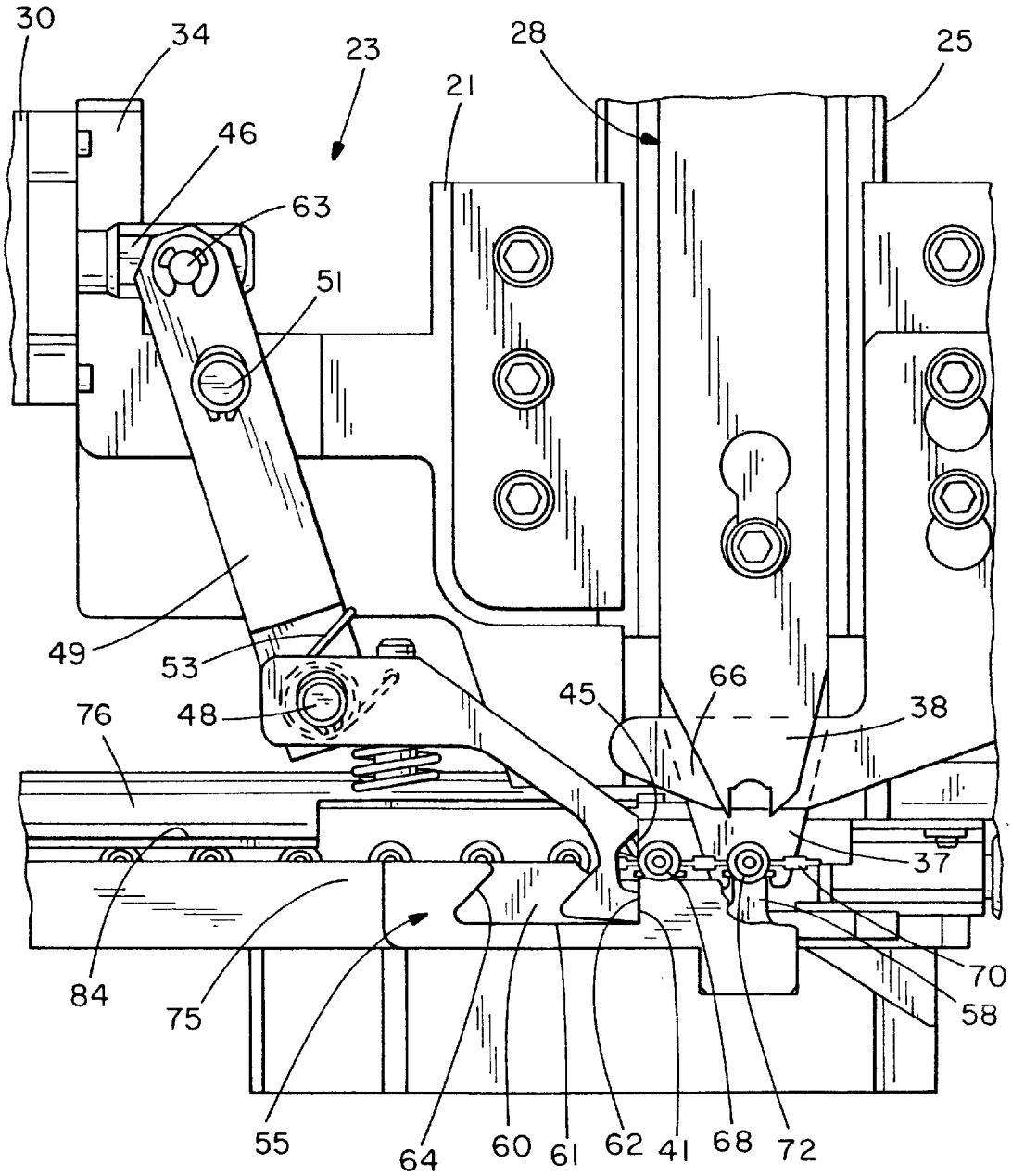
FIG. 9 is a partial front view of the applicator of FIG. 1, showing the feed finger partially broken away and at its advanced feed stop limit.

As best seen in FIGS. 1–5, the terminal feed mechanism 23, mounted on the machine body 21 by flange 34, preferably includes an air cylinder 30, fed by compressed air hoses 31, a slide shaft 46, feed link 49 and a feed finger 52. The slide shaft 46 is reciprocally motivated by the compressed air cylinder 30 between two extremes. A fully extended state, as seen in FIG. 2, positions the feed finger 52 in a first position, while a fully retracted state, as seen in FIGS. 5 and 9, positions the feed finger 52 in a second advanced position. Preferably, the air cylinder 30 has a given operational stroke length which is greater than the movement permitted by movement window 60. Furthermore, other types of terminal feed mechanisms may be used, such as, a camming mechanism as disclosed in U.S. Pat. No. 4,718,160 to Bulanda et al., an electrically switched cylinder as disclosed in U.S. Pat. No. 2,765,468 to Cootes et al., rotary motion as disclosed in U.S. Pat. No. 3,263,316 to Schrader or any other prior art device which uses a feed finger to advance terminals to a position between the crimp dies.

The feed link 49 is pivotally mounted by a pivot shaft 51 to machine body 21. A pin 63, mounted to the slide shaft 46, pivotally carries a first end of the feed link 49 to advance and retract feed finger 52 in accordance with the reciprocation of slide shaft 46. The shaft 48 disposed at the second end of feed link 49 retains a torsion spring 53 and feed finger 52 with a clip 50. The bore 47 through feed finger 52 permits pivotal movement which is biased clockwise against the feed link 49 by torsion spring 53.

Preferably, motion control elements are disposed at the distal end of the feed finger 52. As best seen in FIGS. 3 and 4, the feed guide edge 41 and retract guide edge 42 are disposed on opposite longitudinal edges of the distal end of the feed finger 52. While the feed projection 45 is positioned a short vertical distance above the lower guide surface 44 which serves as the base of the distal end.

The means for controlling movement of the feed finger, the movement control device 65, is disposed in the path of feed finger 52 to limit and precisely locate the forward extent of the advance and the rearward extent of the retract of feed finger 52. An integral form of the movement control device 65 may include a locator block 55, wire guide funnel 56, crimp die 57, severance die 58, and a movement window 60 which may be secured to machine body 21 by bolt 59. Preferably, separate components are used in place of the integral form, where the individual pieces comprise the movement control device 65 and the interchangeable lower die set 54. As seen in FIGS. 1 and 7–9, the interchangeable lower die set 54 comprises the crimp die 57 and severance die 58 which may be individual parts or an integral piece. Disposed on the movement control device 65 is the movement window 60 which is defined by the several edges which interact with the contoured distal end of feed finger, including the horizontally disposed guide lug 61, the vertical feed stop limit 62 and the reversely curved retract stop limit 64. As seen in FIG. 3, the movement control device 65 comprises the movement window 60, wire guide funnel 56 and locator block 55. When formed as a separate piece, the movement control device 65 could be changed to account for a different terminal progression when the same type and size of terminal is being applied without any other adjustment to the applicator.

When assembled, the distal end of feed finger 52 is disposed within the movement window 60 of the movement control device 65 and advanced toward the locator block 55 and ultimately against feed stop limit 62. Thereby, the feed finger 52 precisely positions without over-stroke of the feed mechanism 23, a terminal or connector, carried by feed projection 45, between terminal strip working die pockets of die sets 28 and 54.

Figure 10:
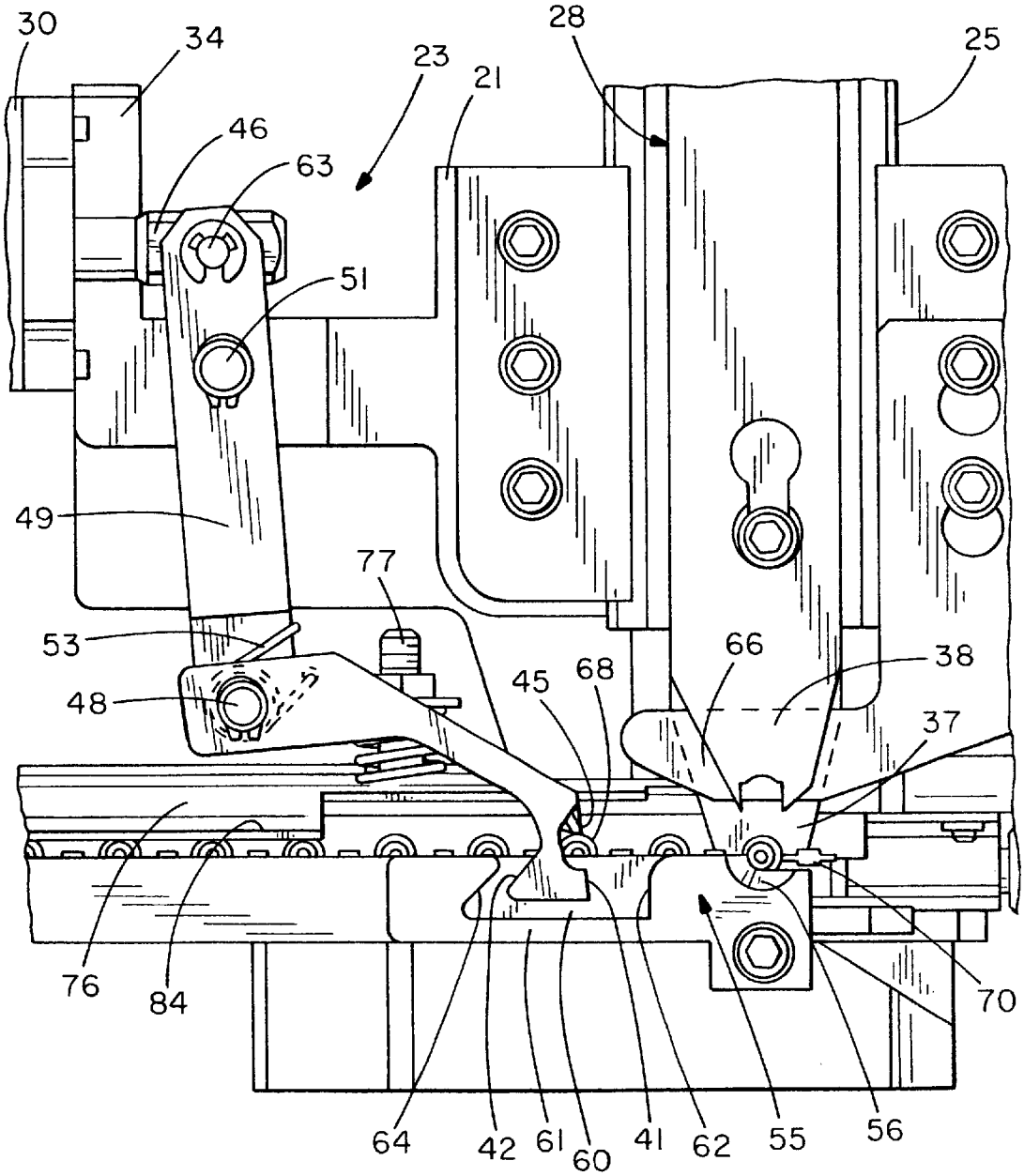
FIG. 10 is a partial front view of the applicator of FIG. 1, showing the feed finger in its middle retract position.

When feed finger 52 is retracted from the locator block 55, the retract guide edge 42 ultimately engages the correspondingly shaped and reversely curved retract stop limit 64 which precisely positions the feed projection 45 and feed finger 52, prohibits over-stroke of the feed mechanism 23, and permits another terminal or connector to be advanced toward the crimp dies 28 and 54 by the feed projection 45. As best seen in FIG. 10, during retraction the torsion spring 53 permits the feed projection 45 to be pulled rearward over the terminals or connectors 72, yet biases the feed finger 52 clockwise to properly position the feed finger 52 for the next advance stroke and thereby not permit excessive retrograde movement.

Track assembly 24 accepts a variety of terminal or connector strips of different widths, shapes, and lengths, and accurately positions the strips relative to the terminal feed mechanism 23 and die sets 28 and 54.

Figure 13:
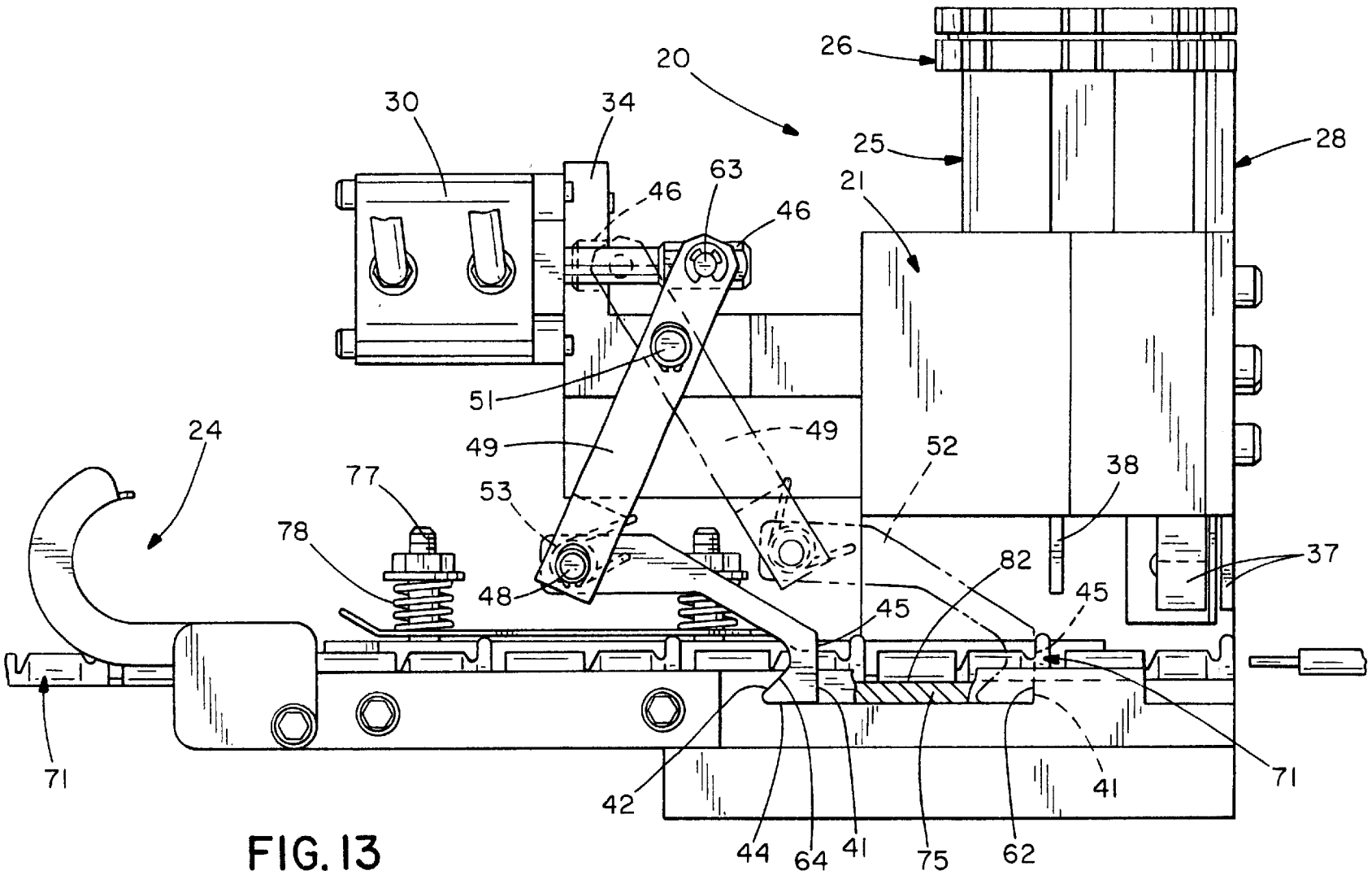
FIG. 13 is a view of the applicator of FIG. 12, showing the range of movement of the feed finger.

Each of these connector or terminal strips includes a continuously molded plastic strip portion 67 having funnel portions 68 aligned along the periphery of the connector strip, barrel portions 69 and ribbon portions 70 interposed between and joining adjacent funnel portions 68. Strip portion 67 carries metal connectors or terminals 72 having a metal crimp barrel portion (not shown) and a metal connector or terminal portion 74. Chain terminals 71, as best seen in FIGS. 12 and 13, are well known in the prior art as formed and linked strips of metal, and consequently will not be discussed in any detail herein.

As best seen in FIGS. 1 and 2, track assembly 24 includes a track 75, track cover 76 which is mounted on and biased toward track 75 by bolts 77 and springs 78 and a drag release 80.

Figure 6:
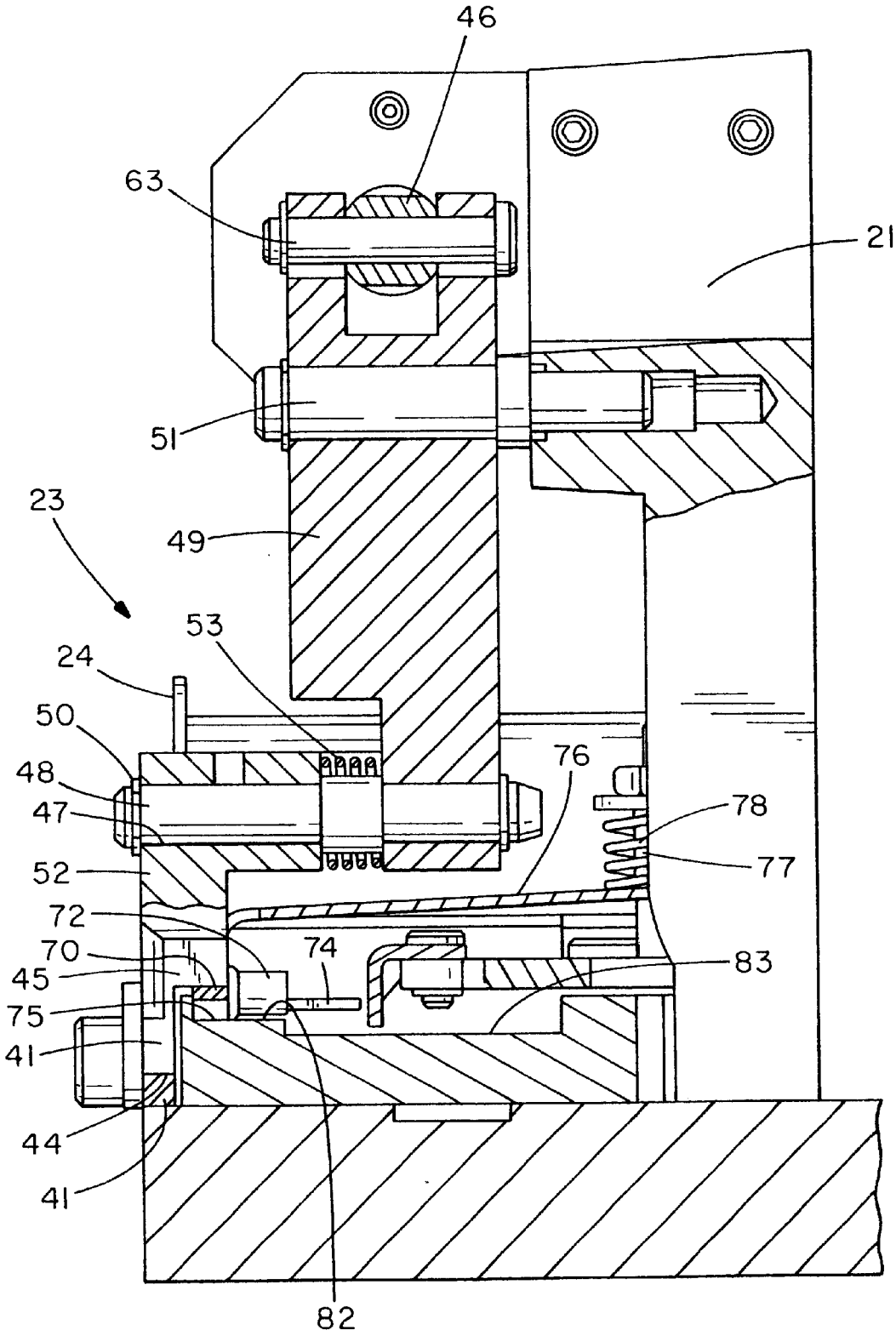
FIG. 6 is a sectional view of the applicator of FIG. 1 taken along line 6—6 of FIG. 2.

To load applicator 20, drag release 80 is first disengaged. A terminal strip is oriented to juxtapose the plastic funnel portions 68 of the strip outwardly of the contact portions of the connector and position the strip between drag floor 82 and drag flange 84. The terminal strip is then inserted between track 75 and track cover 76, and guided through the track assembly 24 to position the lead terminal at a point adjacent die set 54. With insulated terminal or connectors, the metal connector or terminal portions 74 of the terminal strip project over terminal body channel 83, as best seen in FIG. 6. Drag release 80 is reengaged to complete loading. Additionally, loading chain terminals 71 is virtually identical and somewhat simplified due to the head-to-toe orientation.

Figure 8:
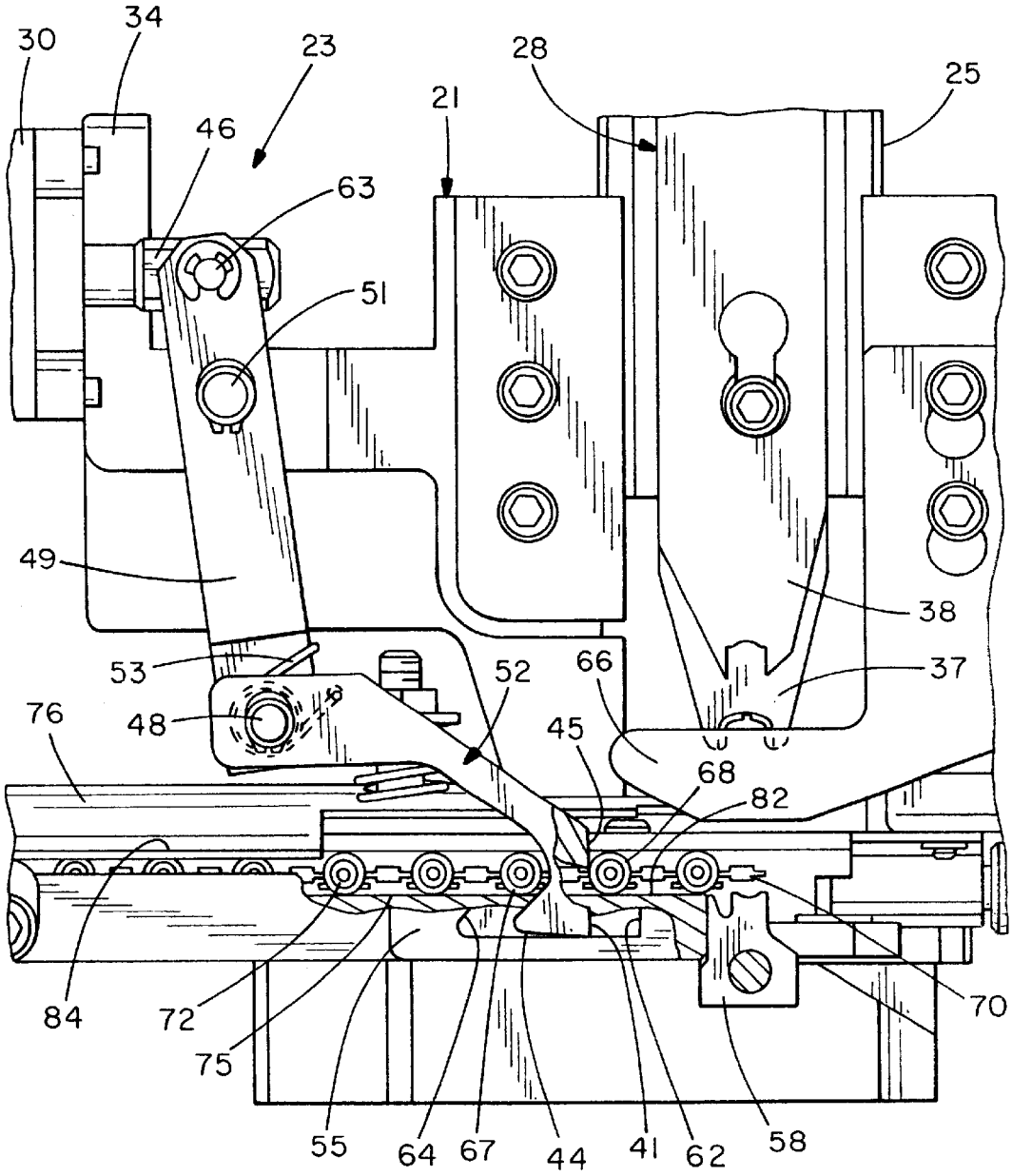
FIG. 8 is a partial front view of the applicator of FIG. 1, showing the feed finger and track partially broken away mid-point during the feed stroke.

The sequence of operation of either applicator 20 after a wire is inserted into the lead terminal and the press is actuated is as follows. As the ram assembly 22 is advanced from a position of full retraction, as seen in FIG. 7 or 12, by a reciprocal press, compressed air is routed through one of the air hoses 31 into the air cylinder 30 so as to force slide shaft 46 to the left which pivots feed link 49 in a counterclockwise direction to resiliently advance the feed finger 52, as seen in FIG. 8 or 13, toward locator block 55. The advancing feed finger 52 overcomes the braking action of track cover 76 to engage funnel portion 68 or corresponding portion of chain terminal of the second terminal to advance and precisely align the lead terminal between die sets 28 and 54. Movement control device 65 is designed to present a feed stop limit 62 that engages feed finger 52 to precisely position the lead terminal in exact alignment with die sets 28 and 54. Feed projection 45 engages the connector or terminal funnel portion 68 or corresponding portion of chain terminal, which is one terminal position removed from the connector or terminal nearing the crimp dies 28 and 54, consequently the result is a second part feed system. This system permits the feed finger 52 to secure the terminal or connector in position during crimping, thus reducing part spring back due to product stretch. Furthermore, the second part feed system provides enough room in the crimp zone to allow a wire guide funnel 56, which makes wire insertion easier and more precise.

Advance of the feed finger 52 is controlled by the movement window 60 of the movement control device 65 in cooperation with torsion spring 53. As seen in FIGS. 8 and 9, feed finger 52 is biased by torsion spring 53 in a clockwise direction such that guide lug 61 interacts with lower guide surface 44 to prohibit further rotational movement. Slide shaft 46 continues further movement to the left until the feed link 49 causes the feed guide edge 41 to abut feed stop limit 62. No further movement of the slide shaft 46, feed link 49 or feed finger 52 is permitted as a result. Since the feed finger 52 is resiliently attached to feed link 49, any minor stroke over-travel of the feeding mechanism 23 is absorbed therein.

As best seen in FIG. 9, ram assembly 22 is advanced until crimp die 37, which extends beyond severance die 38, engages the insulative barrel portion 68 of a terminal strip and traps it against opposing crimp die 57. Resiliently biased crimp die 37 grips the insulative sheath of the terminal with a force great enough to prevent rotation of the terminal during severance of the terminal from the strip by severance dies 38 and 58, but with less than a crimping force; preventing rotation of the terminal induced by severance dies 38 and 58 during severance of the terminal from the strip prevents the possibility of uneven severance of the terminal and damage to the insulation covering the terminal. As the ram is further extended, strip severance dies 38 and 58 sever the terminal from the interconnecting insulation ribbon 70 and immediately thereafter the top edge of crimp die 37 is driven downward by ram assembly 22 with a crimping force until ram assembly 22 is fully advanced to secure the terminal to a wire.

With regard to a chain terminal applicator, as seen in FIGS. 12 and 13, ram assembly 22 is advanced until crimp dies 37, which extends beyond severance die 38, engages the terminal strip and traps it against opposing crimp die 57. Resiliently biased crimp dies 37 grip the terminal with a force great enough to prevent movement of the terminal during severance of the terminal from the strip by severance dies 38 and 58, but with less than a crimping force; preventing movement of the terminal induced by severance dies 38 and 58 during severance of the terminal from the strip prevents the possibility of uneven severance of the terminal and damage to the terminal. As the ram is further extended, strip severance dies 38 and 58 sever the terminal from the interconnecting terminal and immediately thereafter the top edge of crimp die 37 is driven downward by ram assembly 22 with a crimping force until ram assembly 22 is fully advanced to secure the terminal to a wire.

Upon the retraction of ram assembly 22, crimp die 37 extends past severance die 38 to strip the terminated terminal from the die pocket of die 38. As further assurance against a part remaining in the crimp die 37, a stripper projection 66, which is affixed to the machine body and extends between the dies, is included.

As ram assembly 22 is retracted from a point just past full advance, as seen in FIG. 10, the other air hose 31 sends a pneumatic signal to air cylinder 30 to drive slide shaft 46 to the right to pivot feed link 49 clockwise and resiliently retract feed finger 52 and retract guide edge 42 toward and into abutment with retract stop limit 64. The feed projection 45 is withdrawn from the die set 54 and rides up and over the next connector of the strip to be crimped against the force of torsion spring 53. Retrograde movement of the terminal strip is prevented by the braking action of spring biased drag flange 84 against the funnel portions 68 of the terminal strip. Retract guide edge 42 is correspondingly shaped to interlockingly engage the reversely curved retract stop limit 64 such that further movement of the feed finger 52 and feed link 49 is prohibited. Thusly, the movement window 60 of the movement control device 65 controls the advance and retract of the terminal feed mechanism.

Figure 11:
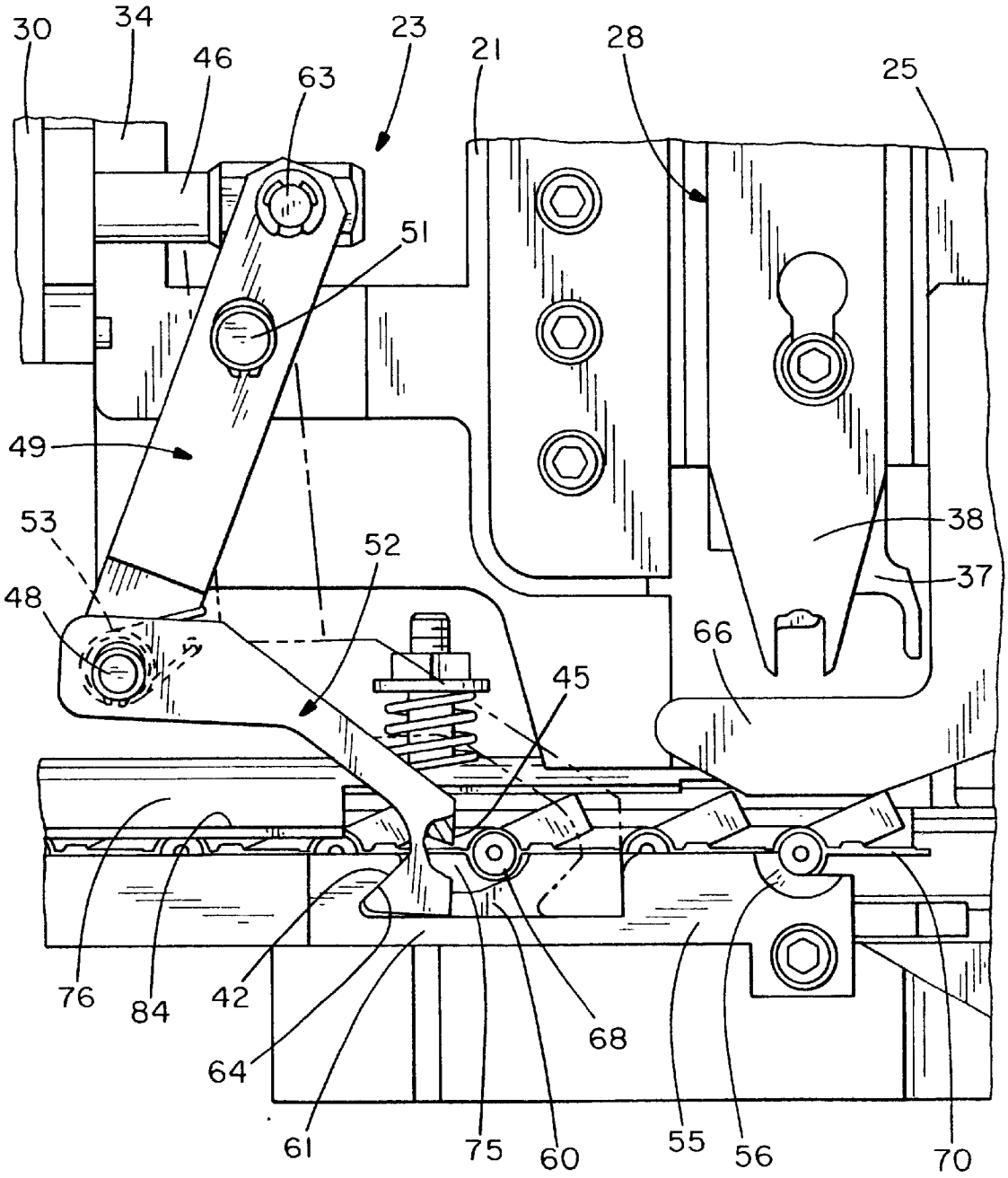
FIG. 11 is a partial front view of the applicator of FIG. 1, showing an interchangeable movement control device having an enlarged movement window.

Typically the continuously molded terminal strips are provided in three standard progressions, with the terminals repeating at 0.460 or 0.600 or 0.750 inches along the terminal strip. Applicator 20 can sequentially feed and automatically accurately position connector strips having a range of different pitches, sizes of crimp barrels and types of terminals by simply changing die sets 28 and 54, movement control device 65 of both. As seen in FIG. 11, movement control device 65 is elongated to accommodate an increased movement window 60, and operates with differently shaped dies 28 and 54 which correspond to the different terminals being applied.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

What is claimed is:

1. A terminal applicator comprising:

a base;

a terminal advancing mechanism disposed on the base comprising a feed finger, having motion control elements including a feed guide edge and a retract guide edge disposed on opposite longitudinal edges of a distal end, operatively associated at a proximal end with means for reciprocally advancing and retracting the feed finger to resiliently bias a terminal strip from a first position to a second advanced position and for sequentially advancing a lead terminal in vertical alignment with upper and lower crimp dies; and a one-piece movement control device removably disposed on the base which captures and operatively associates with the motion control elements on the distal end of the feed finger, having a movement window including a feed stop limit, which limits an advance of the advancing means to accurately dispose the feed finger in the second advanced position and dispose the lead terminal in vertical alignment with the crimp dies, and a retract stop limit, which limits a retraction of the retracting means to accurately dispose the feed finger in the first position.

2. The terminal applicator according to claim 1, wherein the lower crimp die and the movement control device are integral.

3. The terminal applicator according to claim 2, wherein the integral lower crimp die and movement control device are both interchangeably attached to the terminal applicator.

4. The terminal applicator according to claim 2, wherein a wire funnel is incorporated into the crimp die.

5. The terminal applicator according to claim 2 wherein the retract stop limit of the movement window is acutely angled to a direction of retraction of the feed finger.

6. A terminal applicator according to claim 5, wherein the feed stop limit of the movement window is normal to a direction of advancement of the feed finger movement.

7. A terminal applicator according to claim 6, wherein the retract limit and advance limit of the movement window are spaced apart an amount greater than a pitch progression of the terminal strip.

8. A terminal applicator according to claim 6, wherein the retract limit and advance limit of the movement window are spaced apart an amount less than a stroke length of the means for reciprocally advancing and retracting.

9. The terminal applicator according to claim 1 wherein the retract stop limit of the movement window is acutely angled to a direction of retraction of the feed finger.

10. The terminal applicator according to claim 9, wherein the feed stop limit of the movement window is normal to a direction of advancement of the feed finger movement.

11. The terminal applicator according to claim 10, wherein the retract limit and advance limit of the movement window are spaced apart an amount greater than a pitch progression of the terminal strip.

12. The terminal applicator according to claim 10, wherein the retract limit and advance limit of the movement window are spaced apart an amount less than a stroke length of the means for reciprocally advancing and retracting.

* * * * *